United States Patent [19]

Solovieff et al.

[11] 4,100,774

[45] Jul. 18, 1978

[54] LOCKSET HAVING IMPROVED TORQUE BLADE CONSTRUCTION

[75] Inventors: Paul G. Solovieff, Tustin; Robert E. Cyran, Anaheim, both of Calif.

[73] Assignee: Emhart Industries, Inc., Farmington, Conn.

[21] Appl. No.: 798,182

[22] Filed: May 18, 1977

[51] Int. Cl.[2] ..... E05B 17/04

[52] U.S. Cl. ..... 70/380; 70/DIG. 42; 70/DIG. 60

[58] Field of Search ..... 70/370, 372, 373, 374, 70/379 R, 379 A, 380, DIG. 39, DIG. 42, DIG. 60; 292/253

[56] References Cited

U.S. PATENT DOCUMENTS

| | | | |
|---|---|---|---|
| 1,380,116 | 5/1921 | Solaini | 70/136 |
| 2,580,026 | 12/1951 | Jacobi | 70/379 R |
| 2,677,266 | 5/1954 | Hagstrom | 70/379 R |
| 3,851,508 | 12/1974 | McCurdy | 70/370 |

*Primary Examiner*—Robert L. Wolfe
*Attorney, Agent, or Firm*—Mahoney, Schick & Cislo

[57] ABSTRACT

A lockset of the type having a bolt reciprocal from and to a door edge by an operating mechanism including a crank hub and locks at opposite door faces has tubular torque blades between the locks and crank hub for transmitting rotative motion from the locks to the crank hub and ultimately to the bolt for the bolt reciprocations. Both of the torque blades have tubular inner ends of D-shaped cross section with one extending axially a major part of a crank hub D-shaped cross section axial opening and telescoping the other within the crank hub. Outer enlarged tubular ends of the torque blades are telescoped by ends of lock plugs of the respective locks and have partially circumferentially extending slots formed therein receiving radial tongues of washer-like members positioned circumferentially over the lock plug ends. Thus, the torque blade inner ends are single position, rotative drive connected to the crank hub and outer ends thereof are lost motion drive connected to the locks. If a single lock is used with an inside hand operator, a single torque blade may have lost motion connection to the lock, extend completely through the crank hub and be received in the inside hand operator in direct rotative drive therebetween.

25 Claims, 10 Drawing Figures

LOCKSET HAVING IMPROVED TORQUE BLADE CONSTRUCTION

BACKGROUND OF THE INVENTION

This invention relates to a lockset having an improved torque blade construction, the lockset being of the type wherein a bolt is reciprocal from and to a door edge by an operating mechanism including a crank hub and the crank hub is rotated by one or more torque blades, in turn, rotated by one or more actuating mechanisms, such as locks, mounted at faces of the door. Certain of the improvements of the present invention relate generally to the torque blade or blades operable connection to the crank hub of the operating mechanism for transmitting the rotative motion therebetween and to the bolt. Certain other of the improvements of the present invention relate generally to the torque blade or blades lost motion connection to the lock or locks of the lockset. Still other improvements of the present invention relate to the particular structure of the individual torque blades providing appreciable economics in fabrication, while still maintaining more than adequate strength and incorporating one or both of the foregoing improvements.

Various forms of locksets of the general type herein involved have been heretofore provided, all of which have included torque blades in one form or another between the lockset actuating mechanism or mechanisms and the bolt operating mechanism for transmitting the rotative motion therebetween. For instance, presenting the most complex situation to be encountered, assume that both outside and inside lockset actuating mechanisms are involved and that each of these actuating mechanisms is a keyed cylinder-type lock. The usual assembly will be a torque blade operably connected to the lock plug of the outside lock for selective rotation thereby with the torque blade extending partially into the crank hub of the bolt operating mechanism transmitting the rotative motion into extended and retracted movements of the bolt. A similar torque blade would be arranged in the same manner between the inside lock and the operating mechanism crank hub, this torque blade also extending into the crank hub a short distance in axial alignment with the outside lock torque blade. Furthermore, the lockset may be of the "single position assembly" type wherein the torque blades may only be assembled with the crank hub of the operating mechanism in a single predetermined position which insures that during the lockset assembly with the door, the lockset cannot be otherwise than properly assembled which must always result in proper operation after such assembly.

Assuming that the door thickness between faces thereof is compatible with the length of the respective outside and inside lock torque blades so that such torque blades engage in the crank hub of the operating mechanism a sufficient distance to provide proper strength for rotative motion transmission, these prior locksets have been satisfactorily serviceable. The problem arises, however, from the fact that various doors are of various thicknesses. This means that given a particular lockset model, doors with increased thicknesses will result in the respective torque blades engaging the crank hub each a lesser distance with the extreme being total non-engagement, and doors of lesser thickness will have the opposite result with the extreme being end abutment between the two torque blades preventing proper assembly of the locks on the door faces. This, therefore, has the overall result of requiring a relatively large number of lockset models in order to accommodate the varying thicknesses of doors.

Another factor of consideration is that nearly all modern key-actuated locks are constructed for key insertion and removal in a preset "neutral" position. From this neutral position, the key is rotated a partial turn in one direction to extend the lockset bolt and then reversely rotated back to "neutral" for key removal. The same procedure is followed but in the opposite rotative direction for retracting the bolt and then removing the key. The obvious requirement, therefore, is that between the lock plugs of each of the locks and their respective torque blades, there must be lost motion connections if the bolt is to remain in either of its extended or retracted positions while the key is rotated back to neutral for removal.

Although the prior lockset constructions have included the required lost motion connections, the principal difficulty therewith has been that of complexity. Due to the required formation thereof with insured proper operability, quite costly fabrication procedures have been involved which, in turn, add to the overall manufacturing expense of each lockset. Furthermore, such complexity can add appreciably to the production time involved in the original assembly of the locksets, again an additional fabrication expense which translates into ultimate additional consumer cost.

OBJECTS AND SUMMARY OF THE INVENTION

It is, therefore, an object of this invention to provide a lockset having an improved torque blade construction wherein certain of the improvements relate to vastly improved torque blade assembly adjustability permitting a single lockset model to serve for a relatively wide range of door thicknesses and thereby eliminating the many different lockset models previously required with the prior lockset constructions. Considering a lockset having two lockset actuating mechanisms, one at each of the door faces and either selectively operable for moving the bolt into its retracted and extended positions, and in this particular instance whether one or both of the actuating mechanisms is a lock or a hand operator, opposite, axially aligned torque blades are involved connecting the opposed actuating mechanisms to the crank hub of the bolt operating mechanism for transmitting the rotative motion therebetween. According to certain of the improvements of the present invention, at least a female torque blade is formed tubular at least at an inner end thereof and this inner end has a cross sectional shape, both externally and internally, of single position assembly form. The other torque blade is a male torque blade having an inner end adapted for being selectively telescoped by the tubular inner end of the female torque blade and having a corresponding single position assembly form.

Thus, in general operating assembly of the lockset, the tubular inner end of the female torque blade is axially inserted into an axial opening through the crank hub of the bolt operating mechanism, which crank hub opening also has a corresponding single position assembly form. At the same time, the tubular inner end of the female torque blade telescopes over the inner end of the male torque blade within the crank hub opening. The result is that rotative drive between the female torque blade and the crank hub is established, and rotative drive is also established from the male torque blade through the female torque blade and ultimately to the crank hub. Equally important, by forming the female and male torque blades of appropriate length for establishing lengths of proper engagement between the female torque blade and the crank hub and between the female torque blade and the male torque blade, such relationships can be conveniently varied over a relatively wide span of door thicknesses while still maintaining sufficient strength of engagement for absolute proper operation of the lockset so that a single model of the improved lockset serves for the many models of the prior locksets.

It is a further object of this invention to provide a lockset having an improved torque blade construction wherein certain of the torque blade improvements relate to a markedly improved lost motion connection between one or more actuating locks and the associated torque blades. In the preferred form of the improved lost motion connection according to the present invention, the torque blade outer end required to be rotatively connected to the lock plug of the actuating lock is formed tubular and preferably peripherally enlarged over the torque blade inner end, specifically, preferably hollow cylindrical. This enlarged torque blade outer end is simply telescoped by an end of the lock plug and has a circumferential slot formed therein over a part of the total circumference of the torque blade outer end. The simple assembly is completed by a washer-like member which is quickly and conveniently secured over the end of the lock plug and has a radial tongue projecting through the lock plug and into the torque blade outer end slot.

Thus, in operation, rotation of the lock plug of the actuating lock will not rotate the lost motion connected torque blade during movement of the washer-like member tongue circumferentially along the torque blade slot, but upon arrival of the tongue at either of the slot ends, simultaneous lock plug and torque blade rotation will take place. The extent or degree of lost motion, therefore, is easily and conveniently determined by the circumferential length of the particular slot and the slot length positively determines the adaption of the particular lost motion connection to the proper operation of a particular lock and torque blade combination. The overall result is a very easily precalculated lost motion connection of maximum simplicity, completely positive operation and maximum ease of assembly into an efficiently operable form.

It is still a further object of this invention to provide a lockset having an improved torque blade construction which satisfies one or both of the foregoing objects, yet according to certain of the improvements of the present invention the individual torque blades may be of a unique structure which may be originally fabricated in a very economical manner while still maintaining the required strengths for proper operation in use. According to these improvements, not only are the torque blades formed tubular throughout, but each torque blade is formed of a single metal sheet having joining or abutting edges preferably on a single axial line. The preferred reduced torque blade inner ends are formed of the cross sectional shapes for the single position assembly and the preferably enlarged outer ends are preferably formed hollow cylindrical for the unique simplified lost motion connection formation and assembly. In the case where end telescoped, female and male torque blades are involved, the inner end of the male torque blade is not necessarily tubular, but for maximum economy, the male torque blade will be formed in the same unique manner as the tubular female torque blade.

Other objects and advantages of the invention will be apparent from the following specification and the accompanying drawings which are for the purpose of illustration only.

DESCRIPTION OF THE BEST EMBODIMENTS CONTEMPLATED

Figure 1:
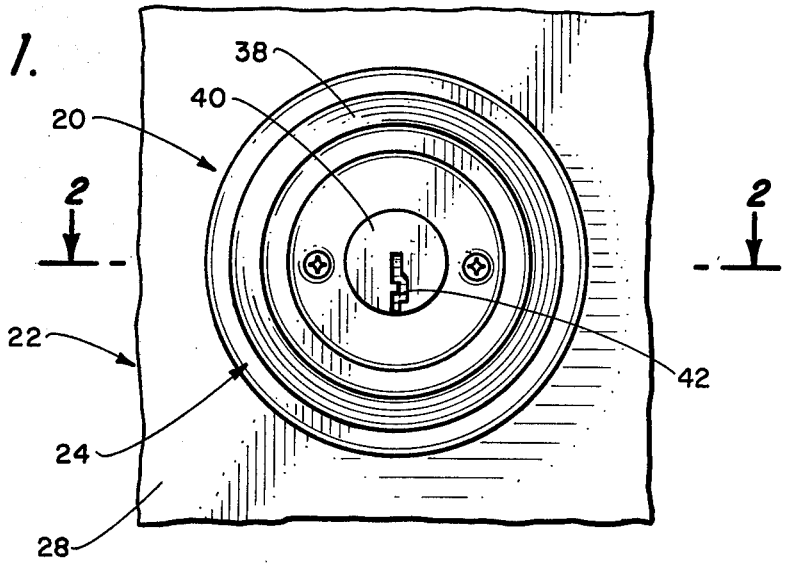
FIG. 1 is a fragmentary, side elevational view looking at a face of a door having a preferred embodiment of the improved lockset of the present invention mounted therein.

Referring to FIGS. 1 through 8 of the drawings, a typical lockset generally indicated at 20 incorporating a preferred embodiment of the torque blade improvements of the present invention is illustrated therein typically mounted in a door generally indicated at 22. With this particular embodiment, the lockset 20 is of the more complex type including opposed actuating mechanisms in the form of opposed first and second keyed, cylinder-type locks generally indicated at 24 and 26 secured at opposite or first and second door faces 28 and 30, respectively, and operably connected in a manner to be hereinafter described to a typical bolt operating mechanism generally indicated at 32 within the door 22 for reciprocal movement of a bolt 34 from and to a door edge 36. As an initial matter, it is pointed out that the lockset 20 illustrated may be manufactured and assembled of usual materials and by usual manufacturing procedures except as otherwise hereinafter specifically explained and pointed out.

More particularly to the lockset 20 forming the environment for the improved torque blade principals of the present invention, the first and second locks 24 and 26 are generally of usual form including covered lock frame assemblies 38 mounting rotatable, keyed lock plugs 40 having key slots 42 and with the lock frame assemblies being secured together and with the door 22 by usual fasteners 44. The bolt operating mechanism 32 includes a frame 46 rotatably mounting a crank hub 48 of a pivotal crank arm 50 which is slot, pivotally connected to rearward ends of a pair of bolt connecting links 52. The forward ends of the bolt connecting links 52 are pivotally connected to the rearward end of the bolt 34 within bolt case 54.

Thus, in general terms, with the proper connections between the lock plugs 40 of the first and second locks 24 and 26, and the crank hub 48, rotatable movement of the lock plugs may be translated into rotatable movement of the crank hub within the bolt operating mechanism 32. Furthermore, rotatable movement of the crank hub 48 through the crank arm 50 and the connecting links 52 may be translated into forward and rearward reciprocal movement of the bolt 34 from and to the door edge 36 all, to this extent, in typical lockset form. Although the bolt 34 with its particular bolt operating mechanism 32 is obviously a deadbolt, it is pointed out that the improved torque blade principals of the present invention are equally as well applicable to a spring latch or latch bolt arrangement and that it is not intended to limit the principals of the present invention to the particular lockset embodiment shown.

Still further as to the general form of lockset, the first and second locks 24 and 26 are both of a well known form wherein the lock plugs 40 must be returned to a "neutral" position which is a downwardly extending vertical position of the key slots 42 before the keys (not shown) may be removed from the key slots. This means that the operable connections between the lock plugs 40 and the bolt operating mechanism 32 must be of "lost motion" form. In other words, the keys can only be inserted and removed from the lock plugs 40 when the key slots 42 are exactly positioned extending vertically downwardly, as shown for instance in FIGS. 1 and 2, which means that starting with the bolt 34 fully extended, for instance, the lock plugs 40 must be capable of starting from this neutral position and being rotated to withdraw the bolt from the fully extended to the fully retracted position and then the lock plugs reversely rotated back to their neutral position while not moving or affecting the position of the bolt. On the other hand, with the bolt in fully retracted position, the lock plugs 40 must be rotatable from their neutral positions to move the bolt from fully retracted to fully extended, and then the lock plugs reversely rotated back to their neutral positions without further moving the bolt or affecting its position.

Specifically to the improved torque blade principals of the present invention, a female torque blade is generally indicated at 56 and includes a reduced, hollow inner end 58 extending axially the majority of the length of the torque blade and tapering outwardly to an enlarged, hollow outer end 60, the female torque blade thereby preferably being hollow end to end. Furthermore, the inner end 58 is of "single position assembly" form, preferably D-shaped in cross section so that the same may only be assembled in a predetermined single position and may not be wrongly assembled. The outer end 60 is hollow cylindrical and has a circumferential slot 62 formed therein terminating endwise in slot ends 64 and occupying approximately two thirds of the outer end circumference.

Figure 2:
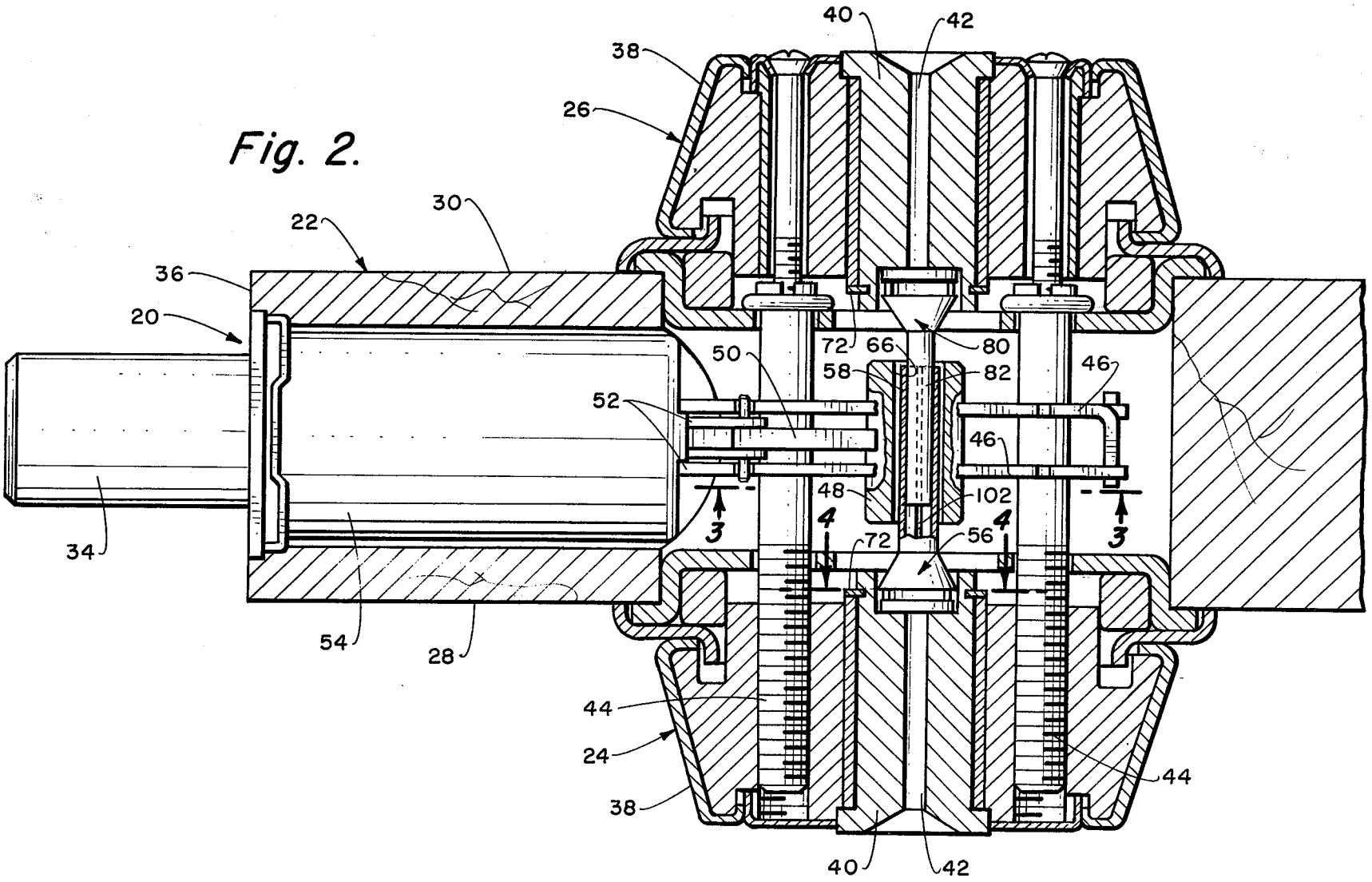
FIG. 2 is an enlarged, fragmentary, horizontal sectional view looking in the direction of the arrows 2—2 in FIG. 1 and showing the lockset in the bolt extended position.
Figure 7:
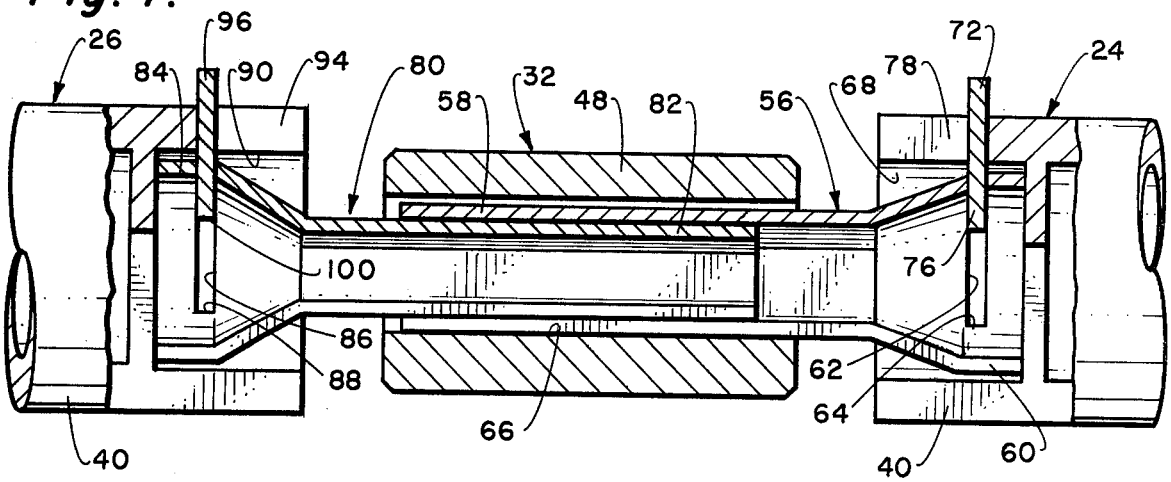
FIG. 7 is a fragmentary vertical sectional view looking in the direction of the arrows 7—7 in FIG. 4 and showing the assembled relationship of the lock plugs, torque blades and operating mechanism crank hub of the lockset of FIG. 2.
Figure 8:
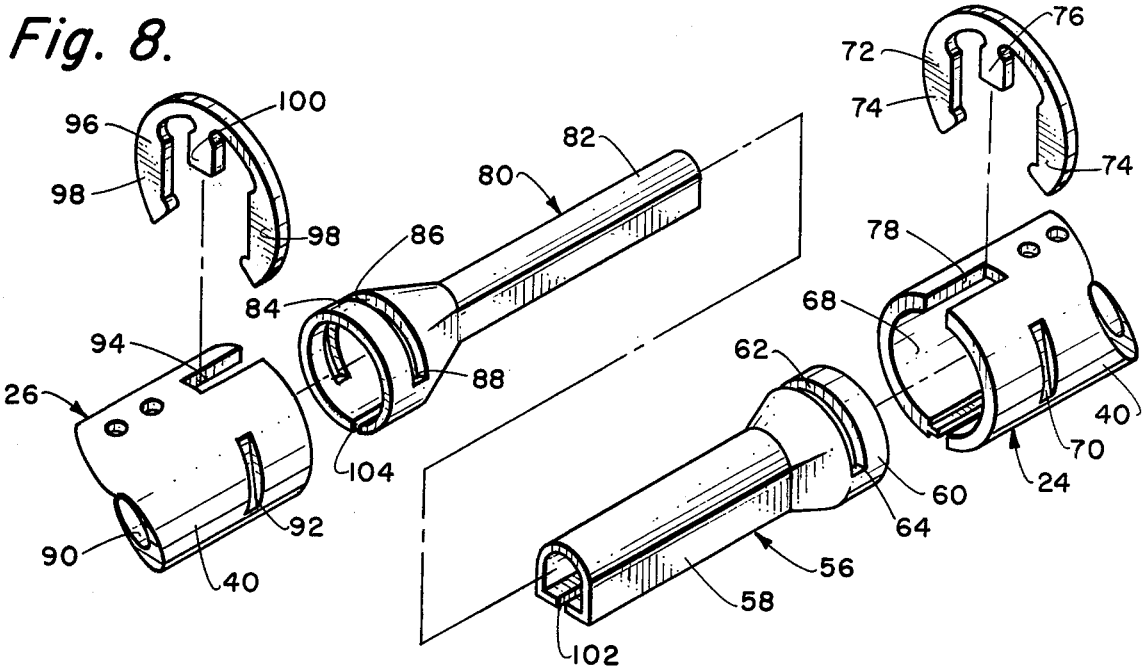
FIG. 8 is a slightly reduced, exploded perspective view of the lock plugs and torque blades of FIG. 7.

In assembly, the inner end 58 of the female torque blade 56 is axially slideably received in an appropriate, relatively closely fitting, D-shaped cross section axial opening 66 through the crank hub 48. It is preferred that this female torque blade inner end 58 will extend axially through the crank hub 48 a majority of the axial length of the crank hub for a maximum secure rotative engagement therebetween as provided by the corresponding D-shapes, the assembly as shown in FIGS. 2 and 7 showing the female torque blade inner end extending nearly the total of the crank hub axial length. Thus, not only is the single position assembly insuring proper assembly provided by the respective D-shapes of the female torque blade inner end 58 and the crank hub axial opening 66, but a secure rotative engagement therebetween is provided for transmitting rotative motions of the female torque blade 56 directly into the crank hub 48 and ultimately into forward and rearward motions of the bolt 34.

The enlarged outer end 60 of the female torque blade 56 is telescoped by a hollow inner or interior end on the lock plug 40 of the first lock 24, that is, within an inwardly opening, cylindrical end recess 68. A pair of radially opening slots 70 are formed at the outer surface in the lock plug 40 of the first lock 24 preferably parallel to the key slot 42 and axially intermediate the lock plug end recess 68 radially aligned with the slot 62 of the female torque blade outer end 60. The assembly of the female torque blade outer end 60 is completed by a washer-like member or clip 72 positioned over the inner end of the lock plug 40 having appropriately spaced legs 74 received in the outer lock plug slot 70 resiliently radially inwardly engaging the lock plug and a central, radially inwardly extending, drive tongue 76 extending inwardly through an axial slot 78 of the lock plug and slideably through the circumferential slot 62 of the female torque blade outer end 60.

Thus, a relatively simple, but efficient, rotative lost motion connection is provided between the female torque blade outer end 60 and the lock plug 40 of the first lock 24. Since the clip 72 is resiliently secured to and moves exactly with the lock plug 40, rotation of the lock plug will cause the clip drive tongue 76 to move circumferentially within the slot 62 of the female torque blade outer end 60 while the female torque blade 56 may remain stationary until the clip drive tongue reaches one or the other of the slot ends 64 for the slot 62. At this time, assuming the same direction and continued rotation of the lock plug 40, engagement of the clip drive tongue 76 at the particular slot end 64 will force the female torque blade 56 to rotate with the lock plug. Obviously, therefore, by proper precalculation of the circumferential length on the slot 62 of the female torque blade outer end 60, sufficient lost motion may be provided between the lock plug 40 of the first lock 24 and the female torque blade 56 for return of the lock plug to its neutral position and key removal while the bolt 34 remains in either of its extended or retracted positions, while at the same time, proper rotative motion may be transmitted for movement of the bolt between its retracted and extended positions, all to be described in sequence during a description of the overall operation of the lockset.

A male torque blade generally indicated at 80 is preferably formed in most respects virtually identical to the female torque blade 56 including a single position assembly, preferably D-shaped cross section, inner end 82 extending the majority of the length of the torque blade and tapering outwardly into an enlarged, hollow cylindrical outer end 84 having the same circumferential slot 86 with slot ends 88. Although the male torque blade inner end 82 could be solid since its interior does not enter into the functioning thereof, it is preferred that the male torque blade 80 will be tubular throughout so as to be hollow end to end. The one major difference between the female torque blade 56 and the male torque blade 80 is that the inner end 82 of the male torque blade, although still D-shaped, is of appropriately smaller cross section sized to be received axially slideably telescoped by the inner end 58 of the female torque blade 56, although relatively closely fitting and establishing rotative engagement therebetween.

For standardization, the outer end 84 of the male torque blade 80 is of substantially identical size to the outer end 60 of the female torque blade 56. This, thereby, permits the interior extremity or inner end on the lock plug 40 of the second lock 26 to be virtually identical to the lock plug 40 of the first lock 24 both in size and shape as previously described. The lock plug 40 of the second lock 26, therefore, includes inwardly opening, cylindrical end recess 90, outer slots 92, axial slot 94 and washer-like member or clip 96 with legs 98 and radial drive tongue 100.

The male torque blade 80 is assembled with the female torque blade 56 and the crank hub 48 by reception of the male torque blade inner end 82 within the female torque blade inner end 58 in telescoped relationship and, again, it is preferred that the male torque blade inner end 82 will extend through the crank hub a majority of the crank hub axial length, it being shown in FIGS. 2 and 7 extending axially nearly the entire distance. The male torque blade enlarged outer end 84 is inserted axially into the lock plug end recess 90 of the second lock 26 and the washer-like clip 96 assembled resiliently outwardly gripping over the lock plug 40 within the slots 92. The drive tongue 100 of the washer-like clip 96, therefore, extends through the lock plug axial slot 94 and into the slot 86 in the male torque blade outer end 84 circumferentially between the slot ends 88.

Briefly functionally, both the female and male torque blades 56 and 80 with their substantially identical outer ends 60 and 84 provide lost motion connections to their respective lock plugs 40 of the first and second locks 24 and 26 required in the particular assembly of the lockset 20. Such lost motion connections are clearly quite simple in form and the assembly thereof is easily accomplished without particular assembly skill merely by the insertion of the particular torque blade outer end 60 or 84 within the respective lock plug end recess 68 or 90 and the quick positioning of the washer-like clip 72 or 96 into the final assembly. At the same time, secure rotative drive is established directly between the female torque blade 56 and the crank hub 48, as well as from the male torque blade 80 through the female torque blade and to the crank hub.

It is apparent that with the telescoped relationship of the female torque blade inner end 58 with the crank hub 48 and the male torque blade inner end 82 primarily with the female torque blade inner end, but also with the crank hub, there is a large degree of adjustability in the spacing of the first and second locks 24 and 26 in the assembly of the lockset 20 while still maintaining positive rotative drive engagement with the crank hub 48. This means that the thickness of the door 22 may vary over a relatively wide range while still providing proper assembly of the lockset 20 with the same female and male torque blades 56 and 80. Although the preferred assembly is that the inner ends 58 and 82 of the female and male torque blades 56 and 80 will extend through the crank hub 48 a majority of the crank hub axial length, even this ideal assembly still permits quite wide variance in the distance between the first and second locks 24 and 26, for instance, starting from the positioning shown in FIGS. 2 and 7, this distance could be increased nearly one-half the axial length of the crank hub while still maintaining a very safe positive engagement between the torque blades and the crank hub, and under lighter rotative drive requirements, the spacing could even be further increased while still maintaining the necessary drive. The overall result is that with the improved female and male torque blade arrangement of the present invention, a single model of the lockset 20 will serve efficiently for doors of quite widely varying widths and will not require the many different models as has been heretofore necessary with the prior construction.

A further improvement of the present invention involves the particular fabrication of the tubular female and male torque blades 56 and 80. In the particular construction shown, it will be noted that the female torque blade 56 has an axial separation line 102 and the male torque blade 80 has an axial separation lone 104. This is due to the fact that each of these torque blades is formed from a single wrapped metal sheet with the edges thereof preferably joining on an axial line appearing as the axial separation line 102 or 104. Once the particular torque blade is formed with its appropriate cross sectional contours, the only further requirements is the formation of the slot 62 in the female torque blade outer end 60 or the slot 86 in the male torque blade outer end 84, thereby providing the maximum of efficiency in fabrication.

Operation of the lockset 20 incorporating the improved female and male torque blades 56 and 80 is shown in the drawings relative to the first lock 24. Starting with the bolt 34 in its extended position and the first lock key slot 42 in its vertically downwardly extending neutral position as shown in FIGS. 1 through 4, the lock plug 40 of the first lock 24 is positioned with the drive tongue 76 of the washer-like clip 72 circumferentially midway of the outer end slot 62 of the female torque blade 56, the female and male torque blades 56 and 80 being in the positions shown in FIGS. 2, 3 and 4. At this stage, due to the positioning of the key slot 42 in its neutral position, the key (not shown) may be removed or inserted.

Figure 3:
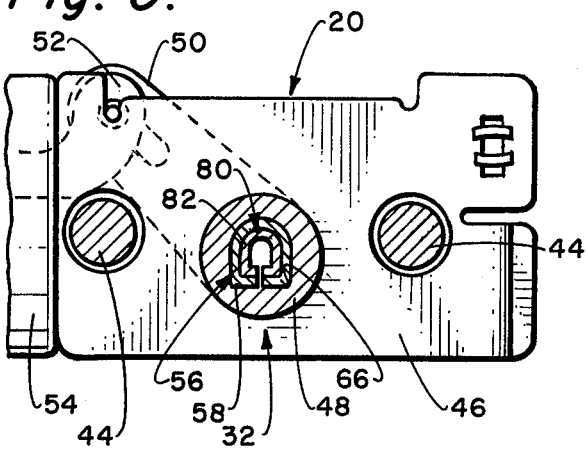
FIG. 3 is a slightly reduced, fragmentary, vertical sectional view looking in the direction of the arrows 3—3 in FIG. 2.
Figure 4:
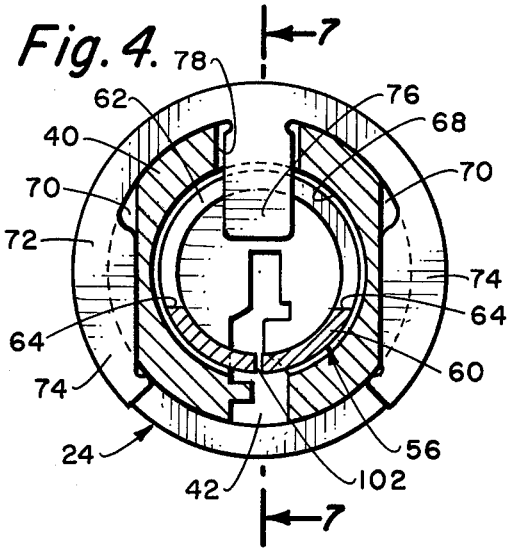
FIG. 4 is an enlarged vertical sectional view through the lock plug and torque blade looking in the direction of the arrows 4—4 in FIG. 2 and with the lock plug and torque blade in the bolt extended position of FIG. 2 with the lock plug returned to "neutral" position for key removal.
Figure 5:
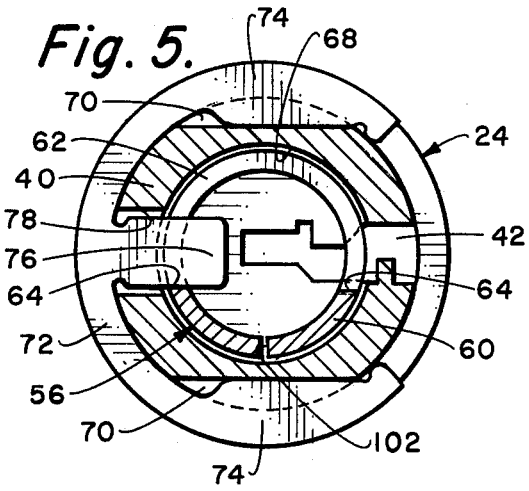
FIG. 5 is a view similar to FIG. 4, but with the lock plug partially rotated just beginning to engage the torque blade for subsequent continued rotation of the lock plug rotating the torque blade to move the bolt from its extended position of FIG. 2 toward retracted position.
Figure 6:
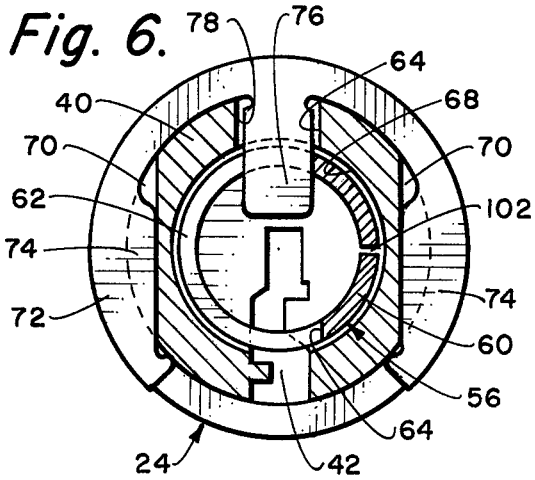
FIG. 6 is a view similar to FIG. 4, but with the lock plug having continued its rotation of FIG. 5 rotating the torque blade to a position moving the bolt into fully retracted position and then the lock plug having been partially reversely rotated back to "neutral" for key removal or for commencement of rotation of the torque blade to move the bolt back toward its extended position.

Beginning the movement for the withdrawal of the bolt 34, the first lock lock plug 40 is started in rotation clockwise as shown in FIGS. 2 and 3 or counterclockwise as shown from the back or inner side in FIG. 4 rotating the washer-like clip drive tongue 76 to the position of FIG. 5 while the female torque blade 56 still remains stationary. In FIG. 5, the washer-like clip drive tongue 76 is just beginning to engage at one of the slot ends 64 of the female torque blade outer end 60. Continuing this same counterclockwise rotation from the position of FIG. 5 moves the female torque blade 56 from the position shown in FIG. 5 to the position shown in FIG. 6, thereby causing consequent rotation of the crank hub 48 to move the crank arm 50 and the connecting links 52 withdrawing the bolt 34 to its fully retracted position. As shown in FIG. 6, the female torque blade 56 has moved to this fully bolt retracted position and the lock plug 40 has been reversely rotated without movement of the female torque blade due to the lost motion connection until the key slot 42 is once again in its neutral position. At this time, the bolt 34 may remain in its fully retracted position while the key is removed from the key slot 42 or continued counterclockwise movement of the lock plug 40 as viewed in FIG. 1 or clockwise movement as viewed in FIG. 6 will immediately start movement of the bolt back toward its extended position.

The movement of the bolt 34 between its extended and retracted positions by the second lock 26 is virtually in the same manner. With either of the first or second locks 24 and 26, the unique and simplified lost motion connections between the female and male torque blades 56 and 80 and their respective lock plugs 40 will always permit return of the lock plugs to neutral position of the key slots 42 for removal and insertion of the keys (not shown). Furthermore, the particular D-shapes of the female and male torque blades 56 and 80 provide the single position assembly of the torque blades, while the simplified tubular construction thereof, telescoping within the crank hub 48, provides adjustment in spacing between the first and second locks 24 and 26 as hereinbefore described. All of the foregoing, in combination with the extremely simplified structures of the female and male torque blades 56 and 80 as well as their simplified assemblies including assembly into the lost motion connections with the respective locks 24 and 26 give marked improvements of the torque blades of the present invention over any of the prior constructions.

Figure 10:
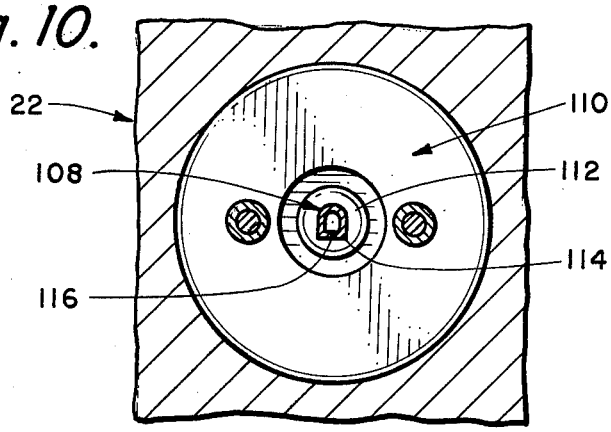
FIG. 10 is a reduced, fragmentary, vertical sectional view looking in the direction of the arrows 10—10 in FIG. 9.
Figure 9:
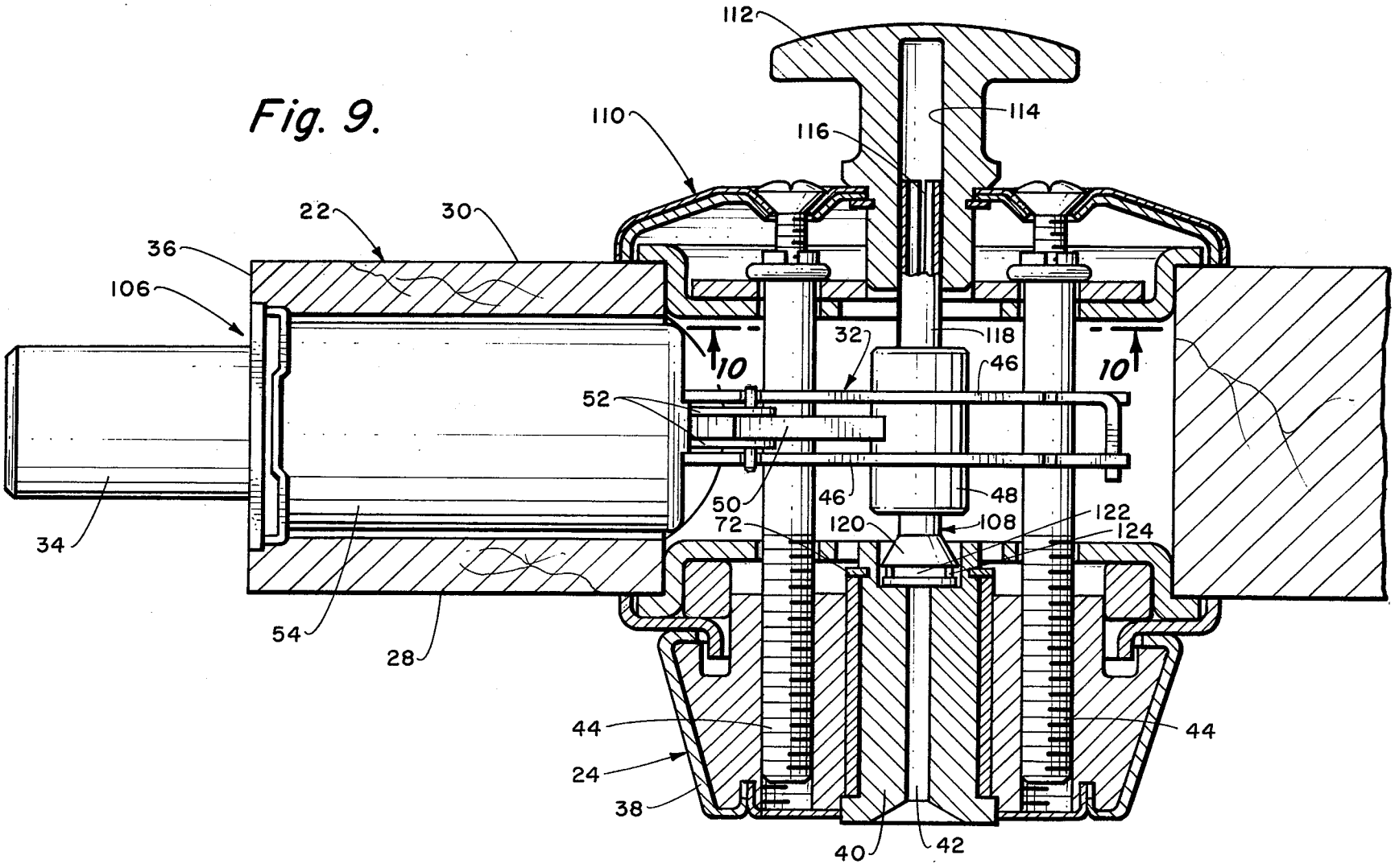
FIG. 9 is a fragmentary horizontal sectional view similar to FIG. 2, but of an alternate preferred embodiment of the improved lockset of the present invention.

An alternate embodiment of lockset incorporating the torque blade improvements of the present invention is shown in FIGS. 9 and 10 incorporating a lockset generally indicated at 106. The lockset 106 is virtually identical to the lockset 20 previously described with the sole exception being the previously described female torque blade 56 replaced by a slightly altered form of female torque blade generally indicated at 108, the elimination of the previously described male torque blade 80, and the replacement of the previously described second lock 26 by a typical lockset thumb knob hand operator generally indicated at 110.

The thumb knob hand operator 110 is positioned secured at the second door face 30 by securement to the first lock 24 through the fasteners 44. Furthermore, this hand operator 110 includes the usual selectively rotatable thumb knob 112 which is inwardly exposed to and axially aligned with the crank hub 48 of the bolt operating mechanism 32 and the lock plug 40 of the first lock 24. The thumb knob 112 has an axially extending, D-shaped opening 114 which is outwardly closed and opens inwardly of the same size and axially aligned with the axial opening 66 through the crank hub 48.

The female torque blade 108 is again hollow or tubular end to end, preferably formed by the same wrapped metal sheet fabrication process resulting in an axial separation line 116. A reduced inner end 118 is the same D-shaped cross section as before, but extends axially from an enlarged outer end 120 completely axially through the crank hub axial opening 66 and well into the thumb knob axial opening 114 so as to establish positive rotative engagement with both the crank hub and the thumb knob. The torque blade outer end 120 is identical to that previously described including circumferential slot 122 terminating at opposite slot ends 124 and being lost motion rotatively attached in the lock plug end recess 68 of the first lock 24 by the washer-like clip 72 through its drive tongue 76.

In operation, therefore, the extension and retraction of the bolt 34 by the first lock 24 is identical to that previously described including the lost motion connection for return of the key slot 42 to its neutral position in either of the bolt extended or retracted positions. The operation by the thumb knob 112 of the hand operator 110 is direct without lost motion in view of the direct rotative engagement of the thumb knob with the inner end 118 of the female torque blade 108 and the direct transmission of this rotative motion into the crank hub 48 and ultimately to extension and retraction motion of the bolt 34. Adjustments of the assembly of the lockset 106 for variations in door thicknesses is permitted by the slideable axial reception of the female torque blade inner end 118 in the thumb knob axial opening 114, with all of the other fabrication, assembly and operational torque blade improvements of the present invention as hereinbefore described being included in this alternate embodiment form.

According to the present invention, therefore, torque blade improvements for locksets have been provided which include distinct advantages over the prior constructions in fabrication, assembly and operation, all in a relatively simple construction or constructions which may be economically manufactured and marketed. Although all of the advantages of the present invention have been incorporated in specific embodiments herein, it is not intended thereby to limit the principals of the present invention beyond the limitations expressed in the appended claims.

We claim:

1. In a lockset of the type having a latch bolt operably connected to a latch operating mechanism mountable in a door for reciprocation of the latch bolt between door edge extended and retracted positions, the latch operating mechanism having a crank hub partially oppositely rotatable for reciprocally moving said latch bolt, first and second actuators mounted at opposite faces of the door operably connected to the crank hub selectively operable for producing said crank hub partial rotations and said latch bolt reciprocations; the improvement comprising: a tubular female torque blade operably connected at an outer end to said first actuator partially rotatable thereby, said female torque blade having an inner end axially slideably positioned in an axial opening through said crank hub, said female torque blade including engagement means at least at said inner end automatically operable between said inner end and crank hub upon said slideable positioning positively requiring preset single position relative circumferential positioning between said inner end and crank hub during said slideable positioning and transmitting rotative motion directly between said inner end and crank hub; a male torque blade operably connected at an outer end to said second actuator partially rotatable thereby, said male torque blade having an inner end axially slideably positioned partially telescoped by said female torque blade inner end, said male torque blade including engagement means at least at said inner end automatically operable between said female and male torque blade inner ends upon said slideable positioning positively requiring preset single position relative circumferential positioning between said inner ends during said slideable positioning and transmitting rotative motion directly between said inner ends and by said female torque blade inner end directly to said crank hub.

2. In a lockset as defined in claim 1 in which said female torque blade extends axially through said crank hub opening at least a major axial part of said crank hub opening.

3. In a lockset as defined in claim 1 in which each of said engagement means of said female and male torque blades include specific single engageable shapes between said female torque blade and said crank hub and between said male torque blade and said female torque blade transmitting said rotative motion directly between said torque blades and crank hub.

4. In a lockset as defined in claim 1 in which said engagement means of said female torque blade includes an external D-shape of said female torque blade inner end received in a D-shape of said crank hub opening and said engagement means of said male torque blade includes an external D-shape of said male torque blade inner end received in an internal D-shape of said female torque blade inner end.

5. In a lockset as defined in claim 1 in which both of said female and male torque blades are tubular throughout opening oppositely axially.

6. In a lockset as defined in claim 1 in which both of said female and male torque blades are tubular throughout opening oppositely axially and each is formed of a single metal sheet having edges abutting on an axial line.

7. In a lockset as defined in claim 1 in which both of said female and male torque blades are tubular throughout opening oppositely axially; and in which said engagement means of said female torque blade includes an exterior D-shape on said female torque blade inner end received in a D-shape of said crank hub opening and said engagement means of said male torque blade includes an exterior D-shape of said male torque blade inner end received in an interior D-shape of said female torque blade inner end.

8. In a lockset as defined in claim 1 in which said operable connection between said female torque blade outer end and said first actuator includes said female torque blade outer end being hollow cylindrical and being axially telescoped by a hollow end portion of said first actuator, a circumferential slot formed in said torque blade outer end at said actuator end portion, said slot extending circumferentially only a part of said torque blade outer end, a washer-like member secured circumferentially over said actuator end portion and having a radial tongue projecting through said actuator end portion and into said torque blade outer end slot permitting relative rotation between said actuator and torque blade during circumferential movement of said washer-like member tongue in said torque blade outer end slot and producing simultaneous rotation during tongue engagement at ends of said slot.

9. In a lockset as defined in claim 1 in which said operable connection between said female torque blade outer end and said first actuator includes said female torque blade outer end being hollow cylindrical and being axially telescoped by a hollow end portion of said first actuator, a circumferential slot formed in said torque blade outer end at said actuator end portion, said slot extending circumferentially only a part of said torque blade outer end, a washer-like member secured circumferentially over said actuator end portion and having a radial tongue projecting through said actuator end portion and into said torque blade outer end slot permitting relative rotation between said actuator and torque blade during circumferential movement of said washer-like member tongue in said torque blade outer end slot and producing simultaneous rotation during tongue engagement at ends of said slot; and in which said female torque blade is formed of a single metal sheet having edges joining on an axial line.

10. In a lockset as defined in claim 1 in which said operable connection of said outer ends of each of said female and male torque blades with their respective first and second actuators include said outer end being hollow cylindrical and axially telescoped by a hollow end portion of said actuator, a circumferential slot formed in said torque blade outer end at said actuator end portion, said slot extending circumferentially only a part of said torque blade outer end, a washer-like member secured circumferentially over said actuator end portion and having a radial tongue projecting through said actuator end portion and into said torque blade outer end slot permitting relative rotation between said actuator and torque blade during circumferential movement of said washer-like member tongue in said torque blade outer end slot and producing simultaneous rotation during tongue engagement at ends of said slot.

11. In a lockset as defined in claim 1 in which said operable connection of said outer ends of each of said female and male torque blades with their respective first and second actuators include said outer end being hollow cylindrical and axially telescoped by a hollow end portion of said actuator, a circumferential slot formed in said torque blade outer end at said actuator end portion, said slot extending circumferentially only a part of said torque blade outer end, a washer-like member secured circumferentially over said actuator end portion and having a radial tongue projecting through said actuator end portion and into said torque blade outer end slot permitting relative rotation between said actuator and torque blade during circumferential movement of said washer-like member tongue in said torque blade outer end slot and producing simultaneous rotation during tongue engagement at ends of said slot; in which said male torque blade is tubular; and in which each of said female and male torque blades is formed from a single metal sheet having edges joined at an axial line.

12. In a lockset as defined in claim 1 in which said inner end of said female torque blade extends through said crank hub axial opening a major axial part of said opening; in which both of said female and male torque blades are tubular throughout opening oppositely axially; in which said engagement means of said female torque blade includes a specific exterior shape of said female torque blade inner end circumferentially engaged with a specific shape of said crank hub opening and said engagement means of said male torque blade includes a specific exterior shape of said male torque blade inner end circumferentially engaged with a specific interior shape of said female torque blade inner end; and in which said operable connection of said outer ends of each of said female and male torque blades with their respective first and second actuators include said outer end being hollow cylindrical and axially telescoped by a hollow end portion of said actuator, a circumferential slot formed in said torque blade outer end at said actuator end portion, said slot extending circumferentially only a part of said torque blade outer end, a washer-like member secured circumferentially over said actuator end portion and having a radial tongue projecting through said actuator end portion and into said torque blade outer end slot permitting relative rotation between said actuator and torque blade during circumferential movement of said washer-like member tongue in said torque blade outer end slot and producing simultaneous rotation during tongue engagement at ends of said slot.

13. In a lockset as defined in claim 1 in which said inner end of said female torque blade extends axially of said crank hub opening a major axial part of said crank hub opening; in which each of said female and male torque blades is tubular throughout opening oppositely axially; in which said engagement means of said female torque blade includes an exterior D-shape of said female torque blade inner end circumferentially engaged with a D-shape of said crank hub opening and said engagement means of said male torque blade includes an exterior D-shape of said male torque blade inner end circumferentially engaged with an interior D-shape of said female torque blade inner end; and in which said operable connection of said outer ends of each of said female and male torque blades with their respective first and second actuators include said outer end being hollow cylindrical and axially telescoped by a hollow end portion of said actuator, a circumferential slot formed in said torque blade outer end at said actuator end portion, said slot extending circumferentially only a part of said torque blade outer end, a washer-like member secured circumferentially over said actuator end portion and having a radial tongue projecting through said actuator end portion and into said torque blade outer end slot permitting relative rotation between said actuator and torque blade during circumferential movement of said washer-like member tongue in said torque blade outer end slot and producing simultaneous rotation during tongue engagement at ends of said slot.

14. In a locket of the type having a latch bolt operably connected to a latch operating mechanism mountable in a door for reciprocation of the latch bolt between door edge extended and retracted positions, the latch operating mechanism having a crank hub partially oppositely rotatable for reciprocally moving said latch bolt, an actuator mounted at a face of the door operably connected to the crank hub selectively operable for producing said crank hub partial rotations and said latch bolt reciprocations; the improvements comprising: a torque blade tubular throughout having an enlarged hollow outer end and a reduced hollow inner end, said outer end including lost motion connection means connecting said outer end to said actuator for rotation with said actuator during a part of said actuator partial rotation and for relative rotation therebetween during a part of said actuator partial rotation, said inner end being axially slideably positioned in an axial opening of said crank hub, said inner end including engagement means automatically operable between said inner end and crank hub upon said slideable positioning positively requiring preset single position relative circumferential positioning between said inner end and crank hub during said slideable positioning and transmitting rotative motion directly between said inner end and crank hub.

15. In a lockset as defined in claim 14 in which said engagement means of said torque blade inner end includes a specific cross-sectional shape of said torque blade inner end circumferentially engaging a corresponding specific cross-sectional shape of said crank hub requiring said single positioning and transmitting said rotative motion.

16. In a lockset as defined in claim 14 in which said engagement means of said torque blade inner end includes both said torque blade inner end and said crank hub opening being formed D-shaped.

17. In a lockset as defined in claim 14 in which said torque blade is formed of a single metal sheet having edges abutting on an axial line; and in which said engagement means of said torque blade inner end includes a specific cross-sectional shape of said torque blade inner end circumferentially engaging a corresponding specific cross-sectional shape of said crank hub requiring said single positioning and transmitting said rotative motion.

18. In a lockset as defined in claim 14 in which said lockset is of the type wherein said actuator is a first actuator at a first face of the door and a second actuator is mounted at a second face of the door; and in which said torque blade inner end is axially slideably positioned extending axially through said crank hub axial opening and to said second actuator being operably connected to said second actuator transmitting partial rotations of said second actuator to said crank hub.

19. In a lockset as defined in claim 14 in which said lost motion connection means of said torque blade outer end includes said torque blade outer end being axially telescoped by a hollow end portion of said actuator, a circumferential slot formed in said torque blade outer end at said actuator end portion, said slot extending circumferentially only a part of said torque blade outer end, a washer-like member secured circumferentially over said actuator end portion and having a radial tongue projecting through said actuator end portion and into said torque blade outer end slot permitting relative rotation between said actuator and torque blade during circumferential movement of said washer-like member tongue in said torque blade outer end slot and producing simultaneous rotation during tongue engagement at ends of said slot; and in which said engagement means of said torque blade inner end includes a specific cross-sectional shape of said torque blade inner end circumferentially engaging a corresponding specific cross-sectional shape of said crank hub requiring said single positioning and transmitting said rotative motion.

20. In a lockset as defined in claim 14 in which said lost motion connection means of said torque blade outer end includes said torque blade outer end being axially telescoped by a hollow end portion of said actuator, a circumferential slot formed in said torque blade outer end at said actuator end portion, said slot extending circumferentially only a part of said torque blade outer end, a washer-like member secured circumferentially over said actuator end portion and having a radial tongue projecting through said actuator end portion and into said torque blade outer end slot permitting relative rotation between said actuator and torque blade during circumferential movement of said washer-like member tongue in said torque blade outer end slot and producing simultaneous rotation during tongue engagement at ends of said slot; in which said engagement means of said torque blade inner end includes both said torque blade inner end and said crank hub opening being formed D-shaped; in which said lockset is of the type wherein said actuator is a first actuator at a first face of the door and a second actuator is mounted at a second face of the door; and in which said torque blade inner end is axially slideably positioned extending axially through said crank hub axial opening and to said second actuator being operably connected to said second actuator transmitting partial rotations of said second actuator to said crank hub.

21. In a lockset of the type having a latch bolt operably connected to a latch operating mechanism mountable in a door for reciprocation of the latch bolt between door edge extended and retracted positions, the latch operating mechanism having a crank hub partially oppositely rotatable for reciprocally moving said latch bolt, an actuator mounted at a face of the door operably connected to the crank hub selectively operable for producing said crank hub partial rotations and said latch bolt reciprocations; the improvements comprising: a torque blade having an inner end engaged with said crank hub directly transmitting rotative motion thereto, a hollow cylindrical outer end on said torque blade axially telescoped by a hollow end portion of said actuator, a circumferential slot formed in said torque blade outer end at said actuator end portion, said slot extending circumferentially only a part of said torque blade outer end, a washer-like member secured circumferentially over said actuator end portion and having a radial tongue projecting through said actuator end portion and into said torque blade outer end slot permitting relative rotation between said actuator and torque blade during circumferential movement of said washer-like member tongue in said torque blade outer end slot and producing simultaneous rotation during tongue engagement at ends of said slot.

22. In a lockset as defined in claim 21 in which diametrically opposite slots are formed in an outer surface of said actuator end portion receiving diametrically opposite parts of said washer-like member therein.

23. In a lockset as defined in claim 21 in which said circumferential slot formed in said torque blade outer end extends circumferentially more than one-half of the circumference of said torque blade outer end.

24. In a lockset as defined in claim 21 in which said washer-like member is formed of spring metal and resiliently clamps circumferentially over said actuator end portion.

25. In a lockset as defined in claim 21 in which diametrically opposite slots are formed in an outer surface of said actuator end portion receiving diametrically opposite parts of said washer-like member therein; in which said circumferential slot formed in said torque blade outer end extends circumferentially more than one-half of the circumference of said torque blade outer end; and in which said washer-like member is formed of spring metal and resiliently clamps circumferentially over said actuator end portion in said slots.

* * * * *